United States Patent [19]

Steinmetz, Jr.

[11] Patent Number: 4,602,552

[45] Date of Patent: Jul. 29, 1986

[54] ZERO ADHESION SYSTEM

[75] Inventor: Joseph N. Steinmetz, Jr., Sunnyvale, Calif.

[73] Assignee: The United States of America as represented by the Secretary of the Air Force, Washington, D.C.

[21] Appl. No.: 623,873

[22] Filed: Jun. 25, 1984

[51] Int. Cl.[4] ..... F41F 3/04

[52] U.S. Cl. ..... 89/1.816; 89/1.8; 89/1.819

[58] Field of Search ..... 89/1.816, 8.817, 1.818, 89/1.810, 1.809, 1.819; 277/166, 212 R

[56] References Cited

U.S. PATENT DOCUMENTS

| | | | |
|---|---|---|---|
| 3,089,388 | 5/1963 | Webster et al. | 89/1.816 |
| 3,124,040 | 3/1964 | Fiedler | 89/1.816 |
| 3,166,978 | 1/1965 | Price et al. | 89/1.816 |
| 3,266,373 | 8/1966 | Brown | 89/1.810 X |
| 3,289,533 | 12/1966 | Brown | 89/1.810 |
| 3,857,321 | 12/1974 | Cohen | 89/1.816 X |
| 4,357,855 | 11/1982 | Merz | 89/1.816 |
| 4,399,999 | 8/1983 | Wold | 89/1.816 X |
| 4,406,211 | 9/1983 | Andersen | 89/1.816 |
| 4,464,972 | 8/1984 | Simon | 89/1.816 |

*Primary Examiner*—David H. Brown

*Attorney, Agent, or Firm*—Donald J. Singer; Jacob N. Erlich; James E. Maslow

[57] ABSTRACT

A zero adhesion system whereby a protective missile launch pad is held against an EPM-coated missile skin surface having an intermediary cloth sheet thereinbetween. The pad comprises a steel sheet having perforated cleats defined therein, which sheet is affixed to the underside of the pad and releasably bears against the intermediary cloth sheet. This arrangement operates such that the protective missile launch pad is freely released from the missile at launch without adhesion to the EPM-coated missile skin.

14 Claims, 4 Drawing Figures

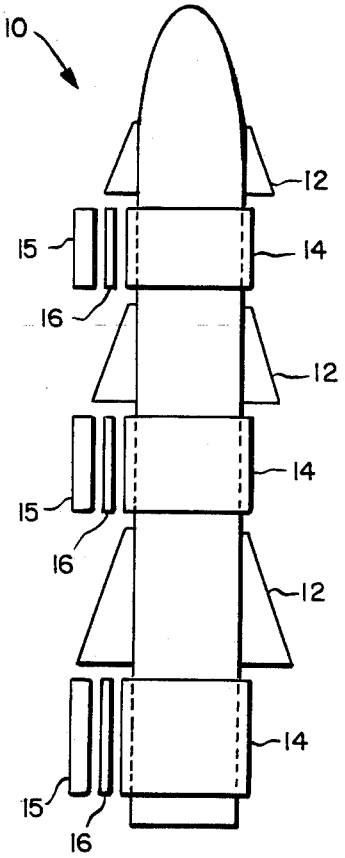
FIG.1
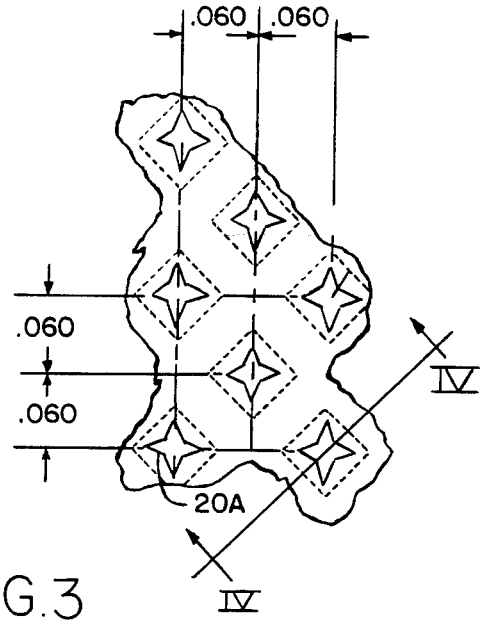
FIG.3
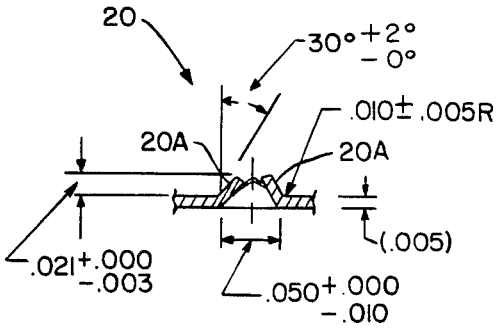
FIG.4
FIG. 2
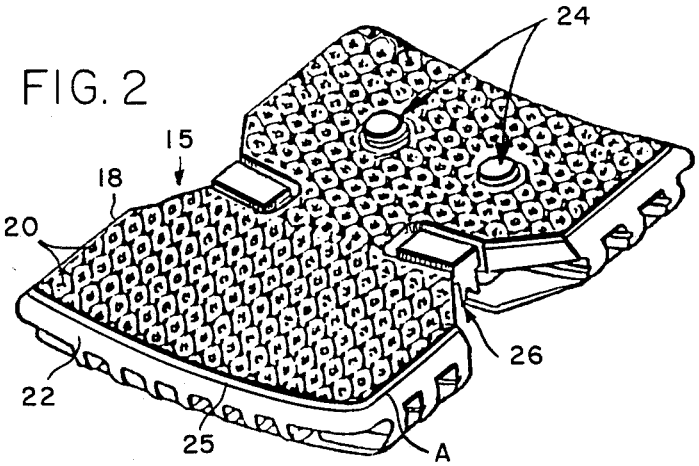

ZERO ADHESION SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates in general to rocket launchers, and more particularly, to a zero adhesion system for use with protective missile launch pads.

Heretofore, missiles have been stowed within missile launch canisters in a variety of manners. It is known in storage and deployment of an MX or Peacekeeper missile, for example, to employ a plurality of protective missile pads, which pads are strategically located between the missile skin and the interior of the supporting launcher canister. Furthermore, in construction of the MX missile, an environmental protection material (EPM) is placed on the stages of the missile at the rocket motor casings. This EPM material is rubber-like in substance, resilient, and typically 0.14 inches thick. One problem, however, with such EPM material is that it has a quality which causes almost all materials which come in contact therewith to adhere to it. Thus, at missile launch, the missile launch pads, which have been secured around the missile for anti-shock protection during stowage, will adhere to the EPM covered missile surface as the missile becomes airborne. This creates an obviously dangerous launch situation which can result in damage to the missile and other obvious negative effects.

SUMMARY OF THE INVENTION

It is therefore an object of the present invention to provide for shock absorbing missile launch pads to be affixed around the circumference of a missile to be protected from shock while in its container, by means of a system which permits no adhesion of the protective launch pad to the EPM-coated missile upon launch. The invention comprises application of a woven cloth between the EPM-coated missile exterior and the underside of cooperating protective launch pads, where this underside comprises a thin metal foil having perforated cleats defined on the surface of the foil.

BRIEF DESCRIPTION OF THE DRAWINGS

The invention will be more clearly understood by reference to the following detailed description of a preferred embodiment thereof in conjunction with the accompanying drawings, in which:

FIG. 1 is a side view of an exemplary EPM-coated missile;

FIG. 2 is a perspective view of a preferred embodiment of a protective missile launch pad;

FIG. 3 is a top view of a portion of a preferred stainless steel sheet having perforated cleats defined therein;

FIG. 4 is a section view of a preferred cleat embodiment taken along line IV—IV of FIG. 3.

DETAILED DESCRIPTION

As seen in FIG. 1, an exemplary missile 10 comprises three rocket stages each stage having fins 12. At the rocket motor portion of each such stage is an EPM-coated area 14 of the missile 10. In prior art arrangements, a missile launch pad 15 might be placed directly in contact with EPM material 14 to provide the missile stowage shock protection as above discussed. In the present arrangement, an intermediate sheet 16 is placed between the protective missile launch pad 15 and the EPM surface 14.

Sheet 16 is preferably a woven cloth 25 mils thick, and is preferably comprised of an aramid fiber characterized as light weight, high strength and high stiffness, such as used in radial tires as a replacement for steel in the belts of the tires, for reinforcement of high-pressure hoses and conveyor belts, or like applications. In a preferred embodiment, sheet 16 is comprised of the material known as Kevlar 29, manufactured by EI DuPont Numors, Inc., Delaware, MD. Kevlar is a trademark owned by DuPont. In any event, sheet 16 should have the following characteristics:

Yarn: 1500 Denier,
Weave: 2×2 Basket,
Count: 34×33+1,
Weight: 14 oz/sq yd nominal,
Thickness: 0.025 nominal, and
Finish: scoured.

Turning now to FIG. 2, there is shown a detailed embodiment of protective missile launch pad 15. Pad 15 comprises a thin stainless steel sheet 18 which is perforated to form a multiplicity of pyramid shaped cleats 20, 20. Stainless steel sheet 18 is bonded to the underside A of a urethane cushion 22. The launch pad also may be provided with conical separation springs 24 which cooperate with spring-receiving recesses defined within pad 15 as seen in FIG. 2. Pad 15 also may be provided with a cable support 26, which functions in a manner described later. In a preferred embodiment, stainless steel sheet 18 is bonded to an intermediary resilient underlayer 25, which underlayer in turn is mounted to the underside A of urethane cushion 22.

As stated above, stainless steel sheet 18 is perforated to form cleats 20, and a portion of a preferred embodiment of sheet 18 is shown in FIG. 3, where cleats 20 are shown spaced 0.060" center-to-center. FIG. 4 is a section view of a preferred cleat embodiment taken along line IV—IV of FIG. 3. Each such cleat 20 is defined by walls **20*a*, which are deformed 30°, +2°, −0°, from the vertical, where the walls are elevated to 0.021", +0.000", −0.003", from the surface of the steel sheet 18. The steel sheet is 0.005" thick, and the deformed area of the cleat measures 0.050", +0.000", −0.010", from the vertex formed by the deformed walls 20*a***. The radius of bend of each vertex is preferably 0.010"+0.005".

In operation of the present invention, a thin stainless steel sheet 18 is perforated to form pyramid shaped cleats 20, as described above. This sheet 18 is bonded to the underside of the urethane cushion 22. In a preferred embodiment an underlayer 25 is placed between steel sheet 18 and pad 22 for the purpose of negating any structural irregularities in the steel sheet 18 or cushion 22. In any event, before the pad 15 is placed against the EPM covered missile surface, a woven cloth 16 is applied as an intermediate buffer sheet between the surface of pad 15 bearing cleats 20 and the missile EPM surface 14. The pad 15, in cooperation with the intermediate sheet 16, is secured to the EPM covered surface of the missile by means of a retention system, such as a cable which will cooperate with cable support 26, by pressure from the canister, or by other suitable means.

Furthermore, when missile 10 is in the vertical launch position, the present arrangement resists shear forces which would be evident thereupon. Such shear forces are resisted by the action of the cleats 20 which dig into the tough, close-woven fibers of sheet 16, where the pad has been affixed to the missile by means of any of the abovesaid retention systems. At the same time, sheet 16 clings to the EPM surface 14 by means of friction and adhesion. Upon launch, when the protective missile launch pads 15 are no longer held tight against the missile, the steel cleats are immediately released from the sheet 16 as the pad 15 is urged away from the missile by means of the separation springs 24. Thus the protective missile launch pads, which protect a missile at rest, can be jettisoned in a manner calculated to minimize danger of injury to the missile at launch.

While the present invention has been described in connection with rather specific embodiments thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A method for obtaining zero adhesion of protective missile launch pads against the skin of a missile at launch, where at least a portion of the missile outer surface is coated with an EPM material, comprising the steps of:

a. placing a close-woven fiberous cloth material on said EPM-coated surface, b. securely releasably mounting a protective missile launch pad having steel cleats on its inner face against said close-woven material with said cleats bearing against said close-woven material.

2. An apparatus to provide for zero adhesion of a protective missile launch pad, which launch pad is designed for retention against a missile for protective storage purposes, said missile having at least a portion of its outer surface covered with an EPM protective material, comprising:

a protective missile launch pad having cleated operative outer surface, an intermediary sheet of close-woven material which does not adhere to the cleats of the protective missile launch pad, means for retention of said pad against said missile, and said means for retention operable to urge said cleated surface against one side of said intermediary sheet when the other side of said intermediary sheet is placed on said EPM-coated missile surface.

3. The apparatus of claim 2, wherein said intermediary sheet has the following characteristics:

Yarn: 1500 Denier,
Weave: 2×2 Basket,
Count: 34×33+1,
Weight: 14 oz/sq yd nominal,
Thickness: 0.025 nominal, and
Finish: scoured.

4. The apparatus of claim 2, wherein said intermediary sheet is approximately 25 mils thick and wherein said cleated protective missile launch pad further comprises a perforated steel sheet and a urethane cushion.

5. The apparatus of claim 4, wherein said steel sheet defines a multiplicity of perforations, said sheet being approximately 0.005 inches thick and said perforations being raised from the surface of said sheet by between 0.018 and 0.021 inches.

6. The apparatus of claim 4, wherein the walls of each said cleat are tapered inward and upward at a typical angle of between 58 and 60 degrees from the surface of said steel sheet.

7. The apparatus of claim 6, further comprising a resilient underlayer located between said perforated steel sheet and said urethane cushion.

8. The apparatus of claim 7, wherein said pad further defines at least one spring-receiving recess on its cleated surface.

9. A protective missile launch pad system for protection of an EPM-coated missile, comprising:

a steel sheet having raised perforated cleats defined on its outer surface, said steel sheet bonded to a resilient underlayer material, said underlayer material in turn bonded to a urethane cushion, a cable support, for receipt of a retention cable, mounted on the rear of said cushion, means for urging said protective missile launch pad away from the skin of the missile at launch cooperative with said cleated steel sheet, and an intermediary sheet for disposition between said EPM-coated missile surface and said cleated steel sheet.

10. The system of claim 9, wherein said means comprises at least one spring-receiving recess defined in said cleated steel sheet for receipt of a conical separation spring.

11. The system of claim 9, wherein said intermediary sheet has the following characteristics:

Yarn: 1500 Denier,
Weave: 2×2 Basket,
Count: 34×33+1,
Weight: 14 oz/sq yd nominal,
Thickness: 0.025 nominal, and
Finish: scoured.

12. The system of claim 9 wherein said intermediary sheet is approximately 25 mils thick.

13. The system of claim 12, wherein said steel sheet defines a multiplicity of perforations, said sheet being approximately 0.005 inches thick and said perforations being raised from the surface of said sheet by between 0.018 and 0.021 inches.

14. The system of claim 13, wherein the walls of each said cleat are tapered inward and upward at a typical angle of between 58 and 60 degrees from the surface of said steel sheet.

* * * * *